US006978757B2

(12) United States Patent
Furuya

(10) Patent No.: US 6,978,757 B2
(45) Date of Patent: Dec. 27, 2005

(54) LUBRICATION STRUCTURE IN ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/011,507

(22) Filed: Dec. 14, 2004

(65) Prior Publication Data

US 2005/0139186 A1 Jun. 30, 2005

(30) Foreign Application Priority Data

Dec. 26, 2003 (JP) ..... 2003-434597

(51) Int. Cl.[7] ..... F01M 9/06

(52) U.S. Cl. ..... 123/196 R; 123/197.4; 184/6.5; 184/11.1

(58) Field of Search ..... 123/196 R, 197.4; 184/6.5, 11.1, 11.4, 13.1

(56) References Cited

U.S. PATENT DOCUMENTS 2,050,723 A * 8/1936 McMillin ..... 184/11.4
2,678,702 A * 5/1954 O'Harrow ..... 184/6.5
5,265,700 A * 11/1993 Santi ..... 184/6.5

FOREIGN PATENT DOCUMENTS

JP 8-284944 11/1996

* cited by examiner

*Primary Examiner*—Weilun Lo
(74) *Attorney, Agent, or Firm*—Smith, Gambrell & Russell

(57) ABSTRACT

A lubrication structure for splash lubrication in an engine includes an oil collector formed as a depression in the outer peripheral surface of the crank pin and an oil groove provided on the big-end of the connecting rod. The oil collector is formed approximately at the center, in an axial direction, of the crank pin. The position of the oil collector is chosen so as to be displaced from an explosive force in an expansion cycle of the engine. The oil groove is provided on the big-end of the connecting rod, and has a first end and a second end. The first end is open in the inner peripheral surface at the center thereof in an axial direction, and the second end is open into the crank case. The oil collector receives oil stored in the crank case and the oil is transferred to the oil groove.

5 Claims, 6 Drawing Sheets

Prior Art

LUBRICATION STRUCTURE IN ENGINE

BACKGROUND OF THE INVENTION

1. Field of the Invention

The present invention relates to a lubrication structure in an engine, and more specifically, to a lubrication structure of a connecting rod big-end in a splash lubrication engine.

2. Discussion of the Related Art

In an engine, a piston contained in a cylinder is connected to a crank shaft via a connecting rod. The connecting rod has a small-end connected to the piston so as to allow the piston to make a reciprocating movement in a bore of the cylinder part. The connecting rod has a big-end connected to a crank pin in a crank case, so as to rotate with respect to each other.

FIG. 8 is a diagram for explaining a known method for lubricating a connecting rod big-end and a crank pin, as described in Japanese Kokai Publication 1996-284944. In FIG. 8, a ring-shaped big-end 102 of a connecting rod 101 is divided into a big-end first half 103 and a big-end second half 104 along a diameter line of an inner peripheral surface of the big-end 102. A crank pin 106 of a crank shaft 105 is received by the big-end first and second halves 103 and 104 and connected thereto by a bolt. The big-end 102 is put between a pair of crank webs 107, which are opposes to each other. Surfaces of the big-end first half 103, formed in the axial direction, face the thrust receiving surfaces 107*a* of the crank webs 107 to contact therewith. On the other hand, the big-end second half 104 is structured to have a width in an axial direction which is narrower than that of the big-end first half 103. Spaces as oil grooves 108 are formed between surfaces of the second half 104, and the thrust receiving surfaces 107. The oil grooves 108 formed on both sides of the second half 14 are in the form of half rings. Namely, each of the oil grooves 108 is defined by a surface of the big-end second halve 104, the trust receiving surface 107 and the outer surface of the crank pin 106.

The thus formed oil grooves 108 in the form of half rings receive oil splash caused by the rotation of a crank shaft 105. The oil in the oil grooves 108 lubricates the outer surface of the crank pin 106, the inner peripheral surface of the connecting rod big-end 102, and the thrust receiving surfaces 107*a* of the crank webs 107.

As schematically shows in FIG. 9, another known structure shows that a big-end 112 of a connecting rod 101 is divided into a big-end first half 113 and a big-end second half 114 along a diameter line of an inner peripheral surface 112*a* of the big-end 112. A crank pin 122 of a crank shaft 121 is received in the big-end first and second halves 103 and 104 and connected thereto by a bolt. A first oil groove 115 is formed on the inner peripheral surface 112*a* of the big-end 112. A second oil groove 116 is perforated in the big-end 112 which communicates the outside of the big-end 112, i.e., inner space in a crank case with the first oil groove 115.

According to the structure shown in FIG. 8, however, it is possible that sufficient lubrication is not provided. This is because the spaces defined by the outer surfaces of the crank pin 106 and the inner peripheral surface of the big-end 102 is extremely small. Therefore, it is difficult to provide a space with a size which is sufficient to permit a proper amount of oil to the center, in an axial direction, of the big-end.

In the lubrication structure shown in FIG. 9, the oil stored in the oil groove 115 is pushed to the side of the bottom of the oil groove 115 because of centrifugal force. This makes it difficult to supply a sufficient amount of oil to a space between the outer surface 122*a* of the crank pin 122 and the inner peripheral surface 112*a* of the big-end 112.

Moreover, the surface areas as sliding surfaces between the outer surface 122*a* of the crank pin 122 and the inner peripheral surface 112*a* of the big-end 112 is decreased by the area of the oil groove 115. In this case, the pressure applied to the sliding surfaces is increased, and hence the relative rotation tends to be less smooth. In this way, satisfactory lubrication may not be achieved.

OBJECT AND SUMMARY OF THE INVENTION

It is therefore an object of the present invention to provide a lubrication structure for a splash lubrication in an engine by increasing the lubrication between an outer surface of a crank pin and an inner peripheral surface of the connecting rod big-end, the engine having a cylinder, a piston provided in the cylinder, a crank case, a crank shaft having a crank pin, the crank shaft being rotatably supported in the crank case, and a connecting rod for connecting the piston and the crank shaft so as to allow the piston to reciprocatingly move in the cylinder, the connecting rod having a small-end and a big-end, the small-end being linked with the piston, the big-end receiving the crank pin with an inner peripheral surface of the big end in contact with an outer peripheral surface of the crank pin so as to rotate with respect to each other, the lubrication structure comprising: an oil collector formed as a depression in the outer peripheral surface of the crank pin approximately at the center of the crank pin in an axial direction, the oil collector being displaced from an explosive force in an expansion cycle of the engine, transmitted from the piston via the connecting rod; and an oil groove provided on the big-end of the connecting rod, the oil groove having a first end and a second end, the first end being open in the inner peripheral surface approximately at the center thereof in an axial direction, the second end being open into the crank case, the oil collector receiving oil stored in the crank case and the oil being transferred to the oil groove.

It is another object of the present invention to provide a lubrication structure wherein the oil groove is supplied with increased amount of oil by easily receiving oil splash in the crank case, wherein the oil groove has a tapered surface which increases in diameter from the first end of the oil groove to the second end of the oil groove.

It is still another object of the invention to provide a lubrication structure wherein the perforating operation is easily carried out and the oil groove easily receives the oil splash by the oil groove being formed at a part which is easily accessible to the oil stored in the bottom of the crank case, wherein the connecting rod comprises a rod portion which integrally connects the small-end with the big-end, the big-end being divided into a first half extending from the rod portion and a second half along a diameter line of the inner peripheral surface of the big-end, and the oil groove being formed in the second half.

BRIEF DESCRIPTION OF THE DRAWINGS

A more complete appreciation of the invention and many of the attendant advantages thereof will be readily perceived as the same becomes better understood by reference to the following detailed description when considered in connection with the accompanying drawings, wherein:

FIG. 4A is viewed in a direction shown by arrow A;

FIG. 5A is viewed in a direction shown by arrow B;

FIG. 6A is viewed in a direction shown by arrow C;

DETAILED DESCRIPTION OF THE INVENTION

Other features of this invention will become apparent in the course of the following description of exemplary embodiments, which are given for illustration of the invention and are not intended to be limiting thereof.

A lubrication structure of a connecting rod big-end in the engine according to the present invention will now be explained by referring to the figures. In the figures, the same reference denotes the same members.

Figure 1:
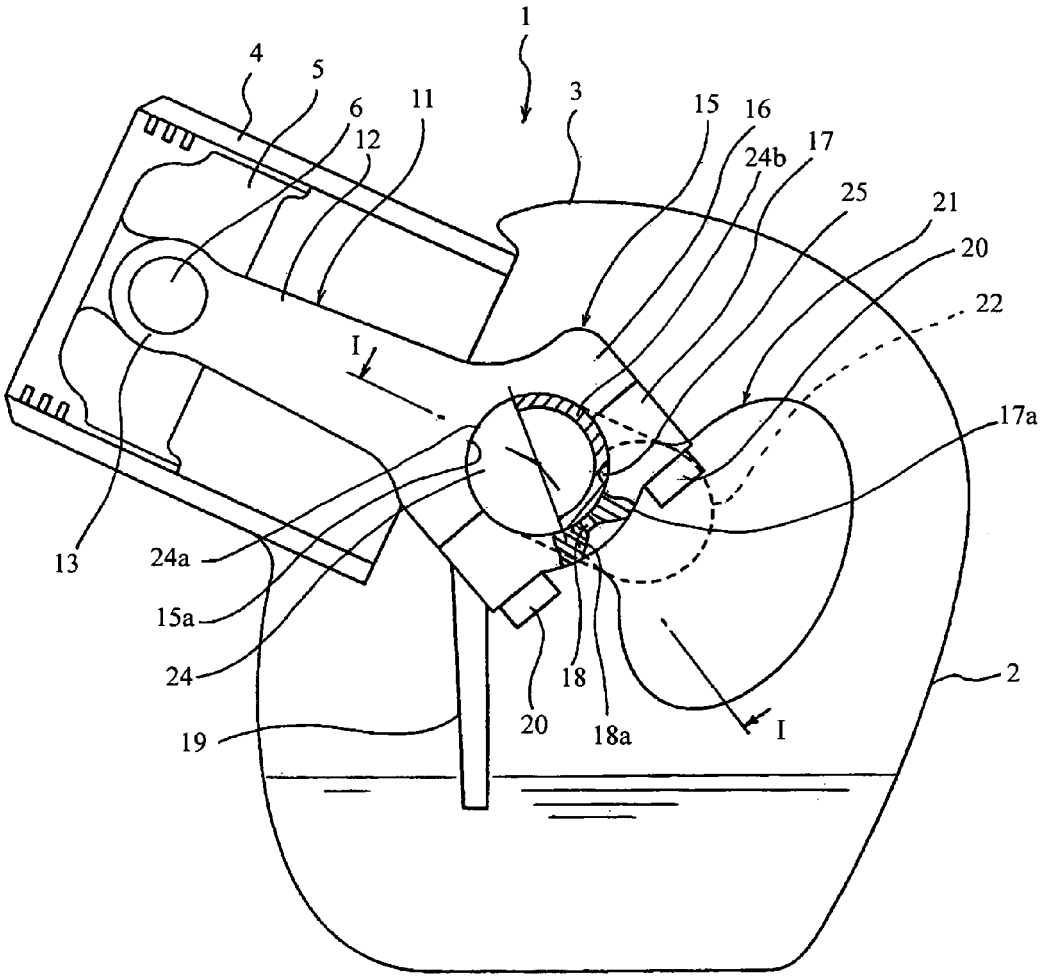
FIG. 1 is a schematic front view of an engine having a lubrication structure of the invention.
Figure 2:
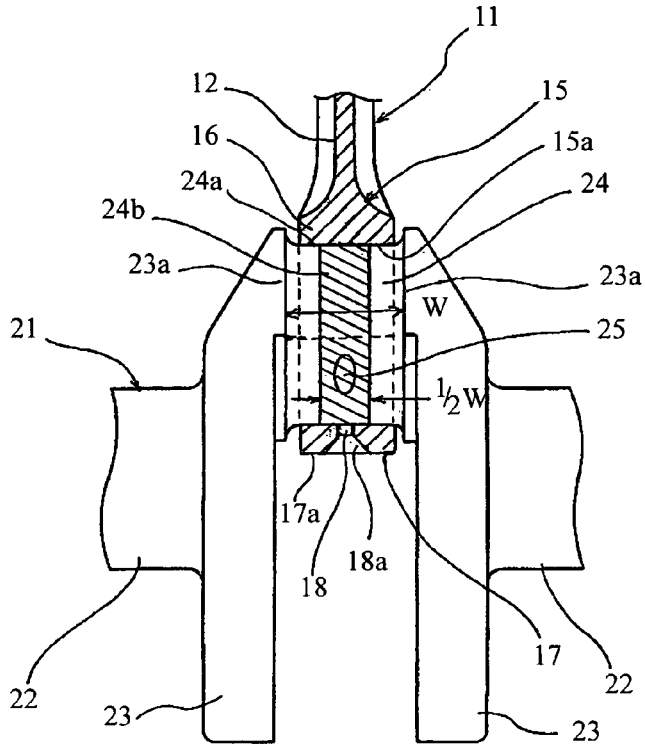
FIG. 2 is a cross-section of FIG. 1 cut along a line I—I.

FIG. 1 is a front view for schematically showing an engine having a lubrication structure according to the present invention, and FIG. 2 is a cross-section of FIG. 1 cut along a line I—I.

An engine 1 is a splash lubrication-type 4-cycle engine. The engine 1 is structured from a crank case 2 and a cylinder case 3 connected thereto. The cylinder case 3 includes a cylinder portion 4 having a cylinder bore therein. A cylinder head (not shown) is attached to the top of the cylinder portion 4.

A piston 5 is provided in the cylinder bore so as to reciprocate therein. On the other hand, the crank case 2 contains a crank shaft 21. The crank shaft 21 is supported on the crank case 2 with journal parts 22 of the crank shaft 21 rotationally applied on the crank case 2 via a bearing (not shown).

The piston 5 is connected to the crank shaft via a connecting rod 11 having a small-end 13 and a big end 15. The small-end 13 of the connecting rod 11 is connected to the piston 5 by way of a piston pin 6 so as to allow relative rotation therebetween. On the other hand, the big-end 15 is provided with a crank pin 24 which is a part of the crank shaft 21, so as to allow relative rotation therebetween. The piston 5 makes a reciprocating movement, whereby the crank shaft 21 is rotationally driven.

An oil scraper 19 is attached to the big-end 15. The oil scraper 19 is in the form of a tongue extending from a lower part of the big-end 15 in a lower direction. The oil scraper 19 splashes oil stored in the crank case 2 into the cylinder case 3 and also in the crank case 2. Therefore, the splashed oil is supplied to each part in the engine 1 for lubricating the same.

The connecting rod 11 is made, for example, by calcinating aluminum alloy powder. The connecting rod 11 is composed of a small-end 13, a big-end 15 and a rod portion 12 integrally connecting the small-end 13 and the big-end 15.

The big-end 15 in the form of a ring is divided along a diameter of an inner peripheral surface 15*a* thereof, into a big-end first half 16 extending from the rod portion 12 and a big-end second half 17 having an oil scraper 19. The first half 16 and the second half 17 receive the crank pin 24 with the inner peripheral surface 15*a* of the first and second halves 16 and 17 contacting with an outer peripheral surface 24*a* of the crank pin 24. The first half 16 is connected with the second half 17 by bolts 20. The second half 17 has an oil groove 18 therein. The oil groove 18 is formed on the second half 17 and extends along a center line of the second half 17 in an axial direction thereof. A first end of the oil groove 18 opens toward the inner peripheral surface 15*a* of the big-end 15, and a second end of the oil groove 18 opens toward an outer peripheral surface 17*a* of the second half 17, i.e., to the crank case 2. The oil groove 18 is prepared so as to have a tapered surface 18*a* which increases in diameter from the inner peripheral surface 15*a* to the outer peripheral surface 17*a*. The oil groove 18 with such tapered lateral surface 18*a* is easily formed in the big-end 15 when the groove 18 is perforated in the second half 17 before the assembly because the second half 17 is relatively small and easy to handle. By the provision of the tapered lateral surface 18*a*, the second end of the oil groove 18 is widely open to the crank case 2 and easily accepts the splashed oil therefrom. Since the oil groove 18 is provided in the second half 17 (an end of the connecting rod), the oil groove 18 is easily accessible to the oil stored in the bottom of the crank case 2.

Both ends of the crank shaft 21 are supported on the crank case 2 via bearings so as to allow the crank shaft 21 to rotate. The crank shaft 21 is integrally formed from a pair of journal parts 22, crank webs 23, and a crank pin 24 connecting the crank webs 23. The crank webs 23 extend from the journal parts 22 and have thrust receiving surfaces 23*a*, which opposes to each other. The crank pin 24 is provided between the thrust receiving surfaces 23*a*.

Figure 3:
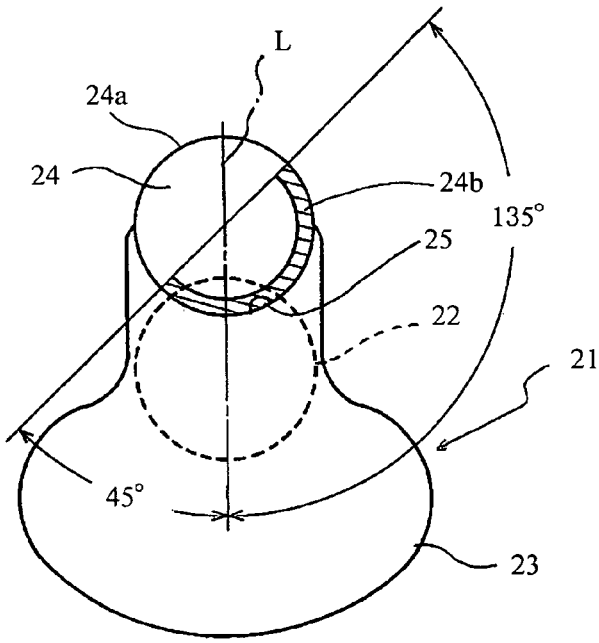
FIG. 3 is a cross-section of a crank shaft for use in a lubrication structure of the invention.

An oil collector 25 is bored in the outer peripheral surface 24*a* of the crank pin 24. For example, the oil collector 25 is formed in an area 24*b* (shown by hatching in FIG. 2 or in FIGS. 1 and 3 (cross-sections)). FIG. 2 shows that the area 24*b* extends from a center line of the crank pin 24 toward ends thereof, with respect to the widthwise direction thereof. The area 24*b* is formed so as to have a width of ½ (½ W) or less with respect to the entire width W of crank pin 24. Furthermore, as described in FIGS. 1 and 3, the area 24*b* is formed at a part of the crank pin 24, which an explosive force applied to the piston 5 does not affect via the connecting rod 11. Moreover, the area 24*b* is formed to cover a range where the splash of the oil is easily accepted by the oil groove 18 when the connecting rod 11 moves in a direction to be closer to the oil stored in the bottom of the crank case. In other words, the area 24*b* across the arc of 180° is formed at a part of the crank pin 24, which is opposite to the piston 5 when the piston is situated at the top dead center in the expansion cycle. The range of 180° is, for instance, defined as an arc-shaped zone with a predetermined width. The range can extend from a point of 135° based on the center line L of the cylinder bore in the anti-rotational direction of the connecting rod to a point of 45° based thereon in the rotational direction of the connecting rod.

Figure 4A:
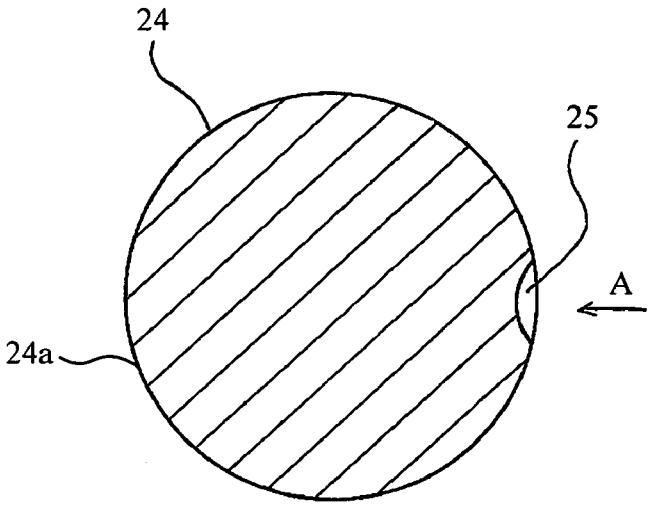
FIG. 4A is a cross-section of a crank pin for explaining an oil collector for use in a lubrication structure of the invention.
Figure 4B:
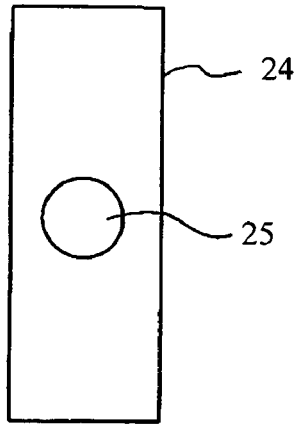
FIG. 4B is a diagram of the crank pin in FIG. 4A when
Figure 5A:
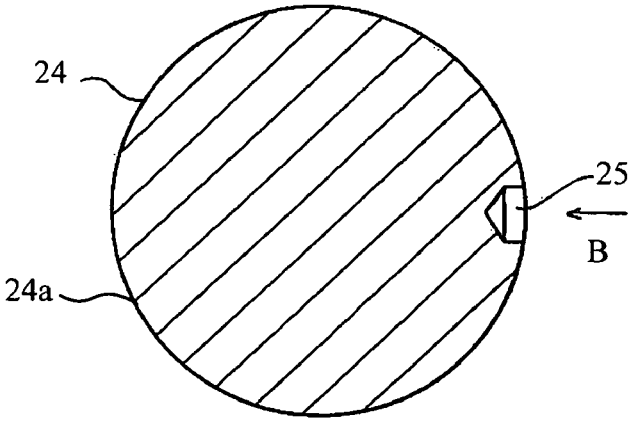
FIG. 5A is a cross-section of a crank pin for explaining an oil collector for use in a lubrication structure of the invention.
Figure 5B:
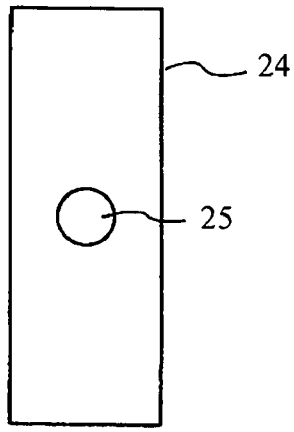
FIG. 5B is a diagram of the crank pin in FIG. 5A when
Figure 6A:
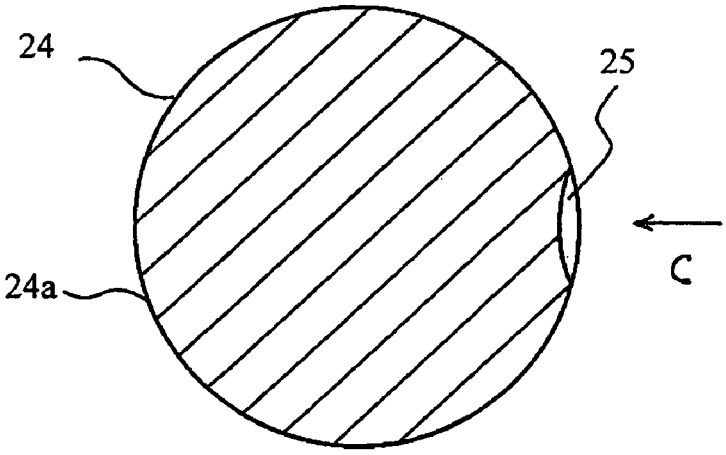
FIG. 6A is a cross-section of a crank pin for explaining an oil collector for use in a lubrication structure of the invention.
Figure 6B:
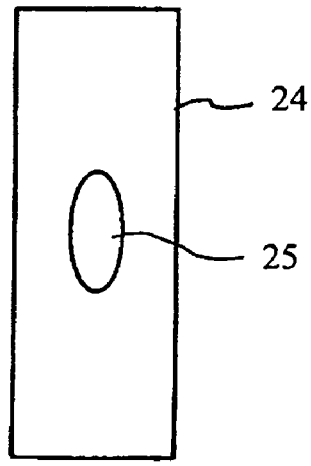
FIG. 6B is a diagram of the crank pin in FIG. 6A when

The shape of the oil collector 25 can be variously chosen. For instance, the oil collector 25 can be formed as a part of a sphere. The oil collector 25 has a cross section in the form of a circular arc when the crank pin 24 is viewed in the cross-sectional direction as shown in FIG. 4A, and a circular shape when viewed in the direction shown by arrow A (FIG. 4B). Alternatively, it is possible to form the oil collector 25 as a combination of a cylindrical part and a cone part as shown by the cross-section of the crank pin 24 in FIG. 5A. The oil collector 25 has a circular shape when the crank pin is seen in the direction shown by arrow B (FIG. 5B). In addition to the above, it is also possible to form the oil collector 25 as a horizontally extending part as shown in the cross-section in FIG. 6A, which can be seen as an oval shape having a horizontal apse line.

As discussed previously, the oil collector 25 is formed in an outer peripheral surface 24 of the crank pin 24 at a part where the explosive force from the piston 5 is not affected. In other words, the oil collector 25 is formed in a crank pin 24 at a part which is least likely to affect the rigidity of the crank pin 24 and which is least likely to affect the surface area which receives surface pressure from the explosion. By the structure of the oil collector 25, it is possible for the crank pin 24 to maintain the necessary surface area of the crank pin 24 where the explosive force is affected. Accordingly, it is possible to prevent the crank pin 24 from substantially losing rigidity. It is also possible to eliminate the previously-described increase of the maximum surface pressure, by the position and the structure of the oil collector 25. Thus, the crank shaft 21 for the present invention can maintain its rigidity, and serves to increase the lubrication of the engine.

The above-mentioned lubrication structure for an engine and the function will now be explained below with referring to FIGS. 7A to 7F.

Figure 7A:
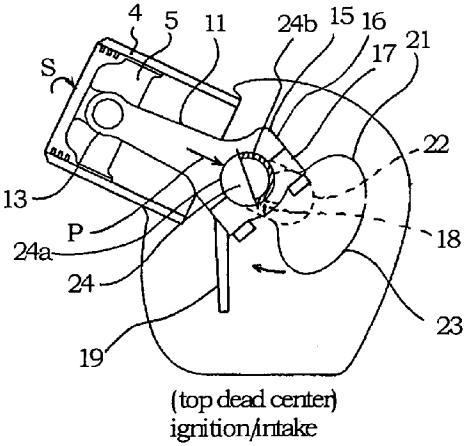
FIGS. 7A to 7F are cross-sections of an engine for explaining the operation/movement of a lubrication structure for a connecting rod big-end.
Figure 7B:
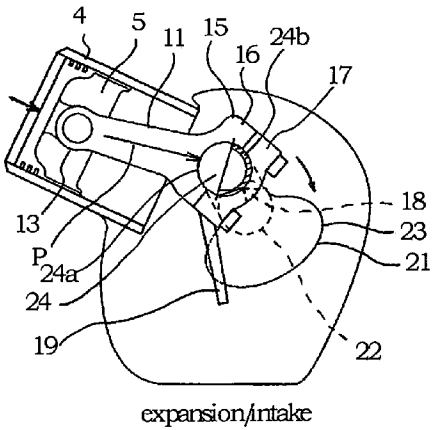
Figure 7C:
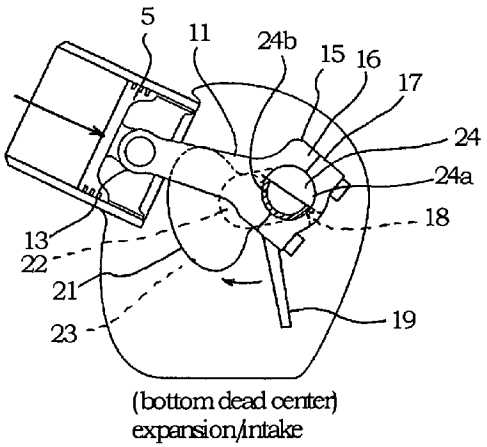

FIGS. 7A and 7C are cross-sections of an engine having a lubrication structure of the present invention where the piston 5 is positioned at the top dead center and at the bottom dead center, respectively. When the piston 5 compresses a gas mixture in a combustion chamber at the top dead center as shown in FIG. 7A, the explosive force acting on the top part of the piston 5 imparts a pivotal force as shown by an arrow S. Moreover, a load P generated by the explosion is applied to the crank pin 24 of the crank shaft 21 via the connecting rod 11.

In the expansion cycle, the crank shaft 21 rotates due to a rotational force generated from the load P. Oil scattered by the oil scraper 19 is accepted by the oil groove 18 which has the tapered surface 18*a* and is open in a lower direction. The oil is introduced into a small gap formed between the inner peripheral surface 15*a* of the big-end 15 and the outer peripheral surface 24*a* of the crank pin 24, and lead to the oil collector 25. Accordingly, the oil collector 25 collects the oil therein.

When the crank shaft 21 rotates in an expansion cycle as shown in FIG. 7B, the connecting rod 11 changes the angle, and hence the oil groove 18 with the tapered surface 18*a* in the second half 17 turns downwardly. In this configuration, the scattered/floating oil is easily accepted by the oil groove 18, and an increased amount of oil is effectively accepted in the oil collector 25 through the oil groove 18. In accordance of the rotation, the oil groove 18 and the oil collecting part 25 come closer to each other, so that an increased amount of oil is easily transferred to the oil collector 25 and maintained therein.

FIG. 7C shows that the crank pin 24 reaches the bottom dead center in the expansion cycle. Here, the oil in the oil collector 25 is uniformly applied to the inner peripheral surface 15*a* of the big-end 15*a*, by the centrifugal force based on the rotation of the crank shaft 21.

Figure 7D:
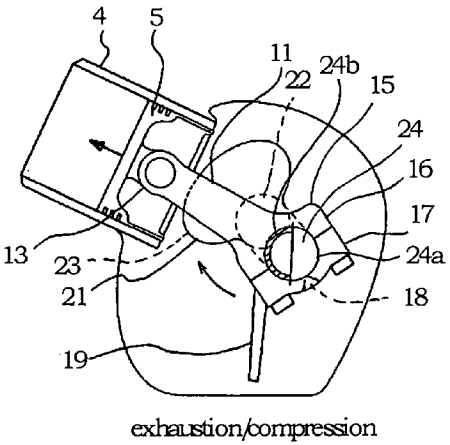

In the expansion cycle, the outer peripheral surface 24*a* of the crank pin 24 receives a maximal load from the explosion via the connecting rod 11. Then, the crank shaft 21 further rotates in the exhaustion cycle as shown in FIG. 7D. In the position shown in FIG. 7D, the oil collector 25 faces a part of the outer peripheral surface 24*a* which received the maximal load in the expansion to apply the oil to the part.

Figure 7E:
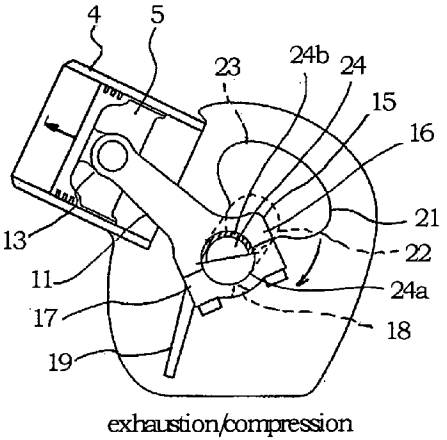
Figure 7F:
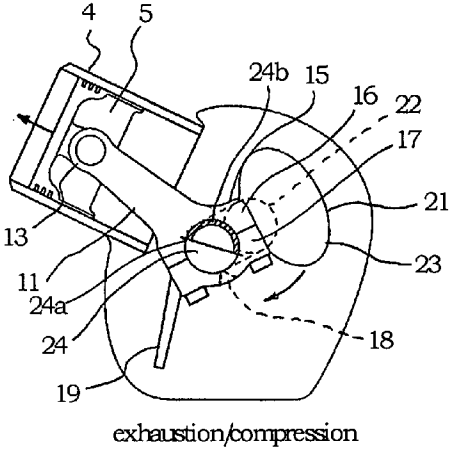
Figure 8:
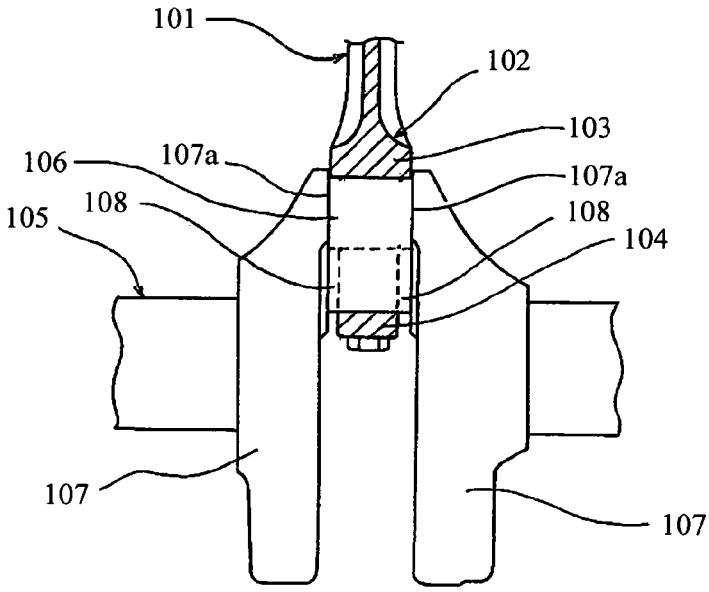
FIG. 8 is a schematic view for explaining a conventional lubrication structure for a connecting rod big-end in an engine.
Figure 9:
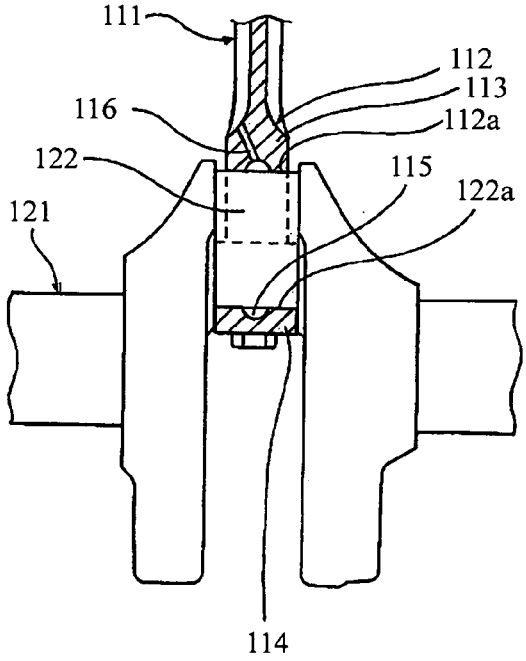
Prior Art FIG. 9
FIG. 9 is a schematic view for explaining a conventional lubrication structure for a connecting rod big-end in an engine.

In the exhaustion cycle as shown in FIGS. 7E and 7F, the oil is uniformly applied to the outer peripheral surface 24*a* of the crank pin 24 and the inner peripheral surface 15*a* of the big-end 15 for lubrication, based on the rotation of the crank shaft 21 and the inclination of the connecting rod 11. In the exhaustion cycle as shown in FIGS. 7E and 7F, the oil groove 18 formed in the big-end second half 17 turns downwardly so as to get closer to the oil surface in the crank case 2. Therefore, a relatively large amount of oil is supplied from the oil groove 18. Passing through the states as shown in FIGS. 7E and 7F, the piston 5 is brought back to the top dead center as shown in FIG. 7A.

FIG. 7A to FIG. 7C also show the intake cycle which is subsequent to the above-discussed expansion and intake cycles. In FIG. 7C (intake cycle), the crank pin 24 is held at a bottom dead center. After the intake cycle shown in FIGS. 7A to 7C, the compression cycle occurs as shown in FIGS. 7D and 7E. In the intake cycle and the compression cycle, the oil is supplied again for lubricating the outer peripheral surface 24*a* of the crank pin 24 and the inner peripheral surface 15*a* of the big-end 15. Thereafter, the piston 5 is brought back to the top dead center as described previously with reference to FIG. 7A. In this way, the expansion cycle, exhaustion cycle, intake cycle and compression cycle are successively performed.

In the present invention, the oil groove 18 having the tapered surface 18*a* in the lubrication structure of the invention receives the scattered oil in the crank case 2 in accordance with the rotation of the crank shaft 21 and the pivotal movement of the connecting rod 11. The oil is transferred from the oil groove 18 to the oil collector 25 formed in the crank pin 24, and collected therein. The oil in the oil collector 25 is supplied to the outer peripheral surface 24*a* of the crank pin 24 and the inner peripheral surface 15*a* of the big-end 15 by a centrifugal force. The oil in a sufficient amount is supplied from a center part of the crank pin 24 in the axial direction, so that satisfactory lubrication is attained.

Moreover, the oil collector 25 is formed in the crank pin 24 at a part displaced from the explosive force. The provision of the oil collector 25 at the above-mentioned position is effective to maintain the surface area of the crank pin 24, that is, to maintain the rigidity of the crank shaft 21. Furthermore, such configuration is effective to decrease the maximum surface pressure. As a result, the lubrication structure of the invention greatly increases the lubrication of the connecting rod big-end.

In the present invention, it is also possible to provide a plurality of oil grooves in the area 24*b* which is not affected by the explosive force from the piston 5 via the connecting rod 11. Furthermore, it is possible to apply the lubrication structure to a two-cycle engine, although the detailed explanation was made only as to the four-cycle engine.

Other structures and functions that may be disclosed in Japanese Patent Application 2003-434597, filed on Dec. 26, 2003 are hereby incorporated by reference into this application.

The present invention being thus described, it will be clearly understood that the same may be varied in many ways. Such variations are not to be regarded as a departure from the spirit and scope of the present invention, and all such modification as would be easily understood to one skilled in the art are intended to be included within the scope of the appended claims.

What is claimed is:

1. A lubrication structure for a splash lubrication in an engine having a cylinder, a piston provided in the cylinder, a crank case, a crank shaft having a crank pin, the crank shaft being rotatably supported in the crank case, and a connecting rod for connecting the piston and the crank shaft so as to allow the piston to reciprocatingly move in the cylinder, the connecting rod having a small end and a big end, the small end being linked with the piston, the big end receiving the crank pin with an inner peripheral surface of the big end in contact with an outer peripheral surface of the crank pin so as to rotate with respect to each other, the lubrication structure comprising:

an oil collector formed as a depression in the outer peripheral surface of the crank pin approximately at the center of the crank pin in an axial direction, the oil collector being displaced from an explosive force in an expansion cycle of the engine, transmitted from the piston via the connecting rod; and an oil groove provided on the big end of the connecting rod, the oil groove having a first and a second end, the first end being open in the inner peripheral surface approximately at the center thereof in an axial direction, the second end being open into the crank case, the oil collector receiving oil stored in the crank case and the oil being transferred to the oil groove;

wherein the connecting rod comprises a rod portion which integrally connects the small end with the big end, the big end being divided into a first half extending from the rod portion and second half along a diameter line of the inner peripheral surface of the big end, and the oil groove being formed in the second half.

2. A lubrication structure for a splash lubrication in an engine having a cylinder, a piston provided to the cylinder, a crank case, a crank shaft having a crank pin, the crank shaft being rotatably supported in the crank case, and a connecting rod for connecting the piston and the crank shaft so as to allow the piston to reciprocatingly move in the cylinder, the connecting rod having a small-end and a big end, the small end being linked with the piston, the big end receiving the crank pin with an inner peripheral surface of the big end in contact with an outer peripheral surface of the crank pin so as to rotate with respect to each other, the lubrication structure comprising:

an oil collector formed as a depression in the outer peripheral surface of the crank pin approximately at the center of the crank pin in an axial direction, the oil collector being formed within an area at a part of the crank pin, which is opposite to the piston when the piston is situated at the top dead center in the expansion cycle; and an oil groove provided on the big end of the connecting rod, the oil groove having a first end and a second end, the first end being open in the inner peripheral surface approximately at the center thereof in an axial direction, the second end being open into the crank case, the oil collector receiving oil stored in the crank case and the oil being transferred to the oil groove.

3. The lubrication structure as claimed in claim 2, wherein the oil groove has a tapered surface which increases in diameter from the first end of the oil groove to the second end of the oil groove.

4. The lubrication structure as claimed n claim 2, wherein the connecting rod comprises a rod portion which integrally connects the small end with the big end, the big end being divided into a first half extending from the rod portion and a second half along a diameter line of the inner peripheral surface of the big end, and the oil groove being formed in the second half.

5. The lubrication structure as claimed in claim 2, wherein said area is adapted to extend from a point of 135° in the anti-rotational direction of the connecting rod with respect to the center line of the cylinder bore to a point of 45° in the rotational direction of the connecting rod with respect to the center line of the cylinder bore.

* * * * *